US007509970B2

(12) United States Patent
Garcia et al.

(10) Patent No.: US 7,509,970 B2
(45) Date of Patent: Mar. 31, 2009

(54) ADAPTABLE WATER CONNECTION FOR FIRE FIGHTING EQUIPMENT AND CONNECTION DEVICE

(76) Inventors: Rodolfo Garcia, P.O. Box 276, Huntington Park, CA (US) 90255; James L. Brown, 431 Plaza Estival, San Clemente, CA (US) 92672

( * ) Notice: Subject to any disclaimer, the term of this patent is extended or adjusted under 35 U.S.C. 154(b) by 0 days.

(21) Appl. No.: 11/999,281

(22) Filed: Dec. 6, 2007

(65) Prior Publication Data

US 2009/0025798 A1 Jan. 29, 2009

Related U.S. Application Data

(60) Provisional application No. 60/961,453, filed on Jul. 23, 2007.

(51) Int. Cl.
*E03B 9/02* (2006.01)
*F16K 31/54* (2006.01)

(52) U.S. Cl. ..... 137/293; 137/295; 137/272; 137/382; 137/377; 251/305

(58) Field of Classification Search ..... 137/294, 137/295, 296, 293, 285, 322, 385, 382, 272, 137/377; 251/305
See application file for complete search history.

(56) References Cited

U.S. PATENT DOCUMENTS 2,629,395 A * 2/1953 Krone et al. ..... 137/283
3,311,128 A * 3/1967 Taylor ..... 137/383
3,752,179 A 8/1973 Atkins et al.
4,266,753 A * 5/1981 Okada ..... 251/305
5,690,141 A * 11/1997 Creaghe ..... 137/382
5,803,110 A 9/1998 Segal
5,901,738 A 5/1999 Miller
6,095,174 A 8/2000 Miller
6,216,792 B1 4/2001 Miller
6,694,783 B2 * 2/2004 Trempala ..... 137/296

* cited by examiner

*Primary Examiner*—Kevin L Lee
(74) *Attorney, Agent, or Firm*—Kirk A. Buhler; Buhler & Associates

(57) ABSTRACT

Improvements in present day fire hydrants are presented. The improvement relates to a fire hydrant where the above ground structure is essentially removed and is replaced with an adaptable connection. The connection uses the same mounting hole pattern as used in the above ground hydrant. In operation, the adaptable connection is protected by a hinged cover that is opened to provide access to the adaptable connection. The adaptable connection includes a bayonet type connection where a portable fire hydrant is secured and rotated to start the flow of water. The adaptable fire connection eliminates the appearance of the fire hydrant, the potential of a vehicle hitting a fire hydrant and the material cost associated with above ground fire hydrants.

17 Claims, 6 Drawing Sheets

ADAPTABLE WATER CONNECTION FOR FIRE FIGHTING EQUIPMENT AND CONNECTION DEVICE

CROSS REFERENCE TO RELATED APPLICATION

This application claims the benefit of Provisional 60/961,453 filed Jul. 23, 2007 the entire contents of which is hereby expressly incorporated by reference herein.

FIELD OF THE INVENTION

This invention relates to improvements in providing water for firefighting equipment. More particularly, the present improvement relates to a fire hydrant where the above ground structure is essentially removed and an adaptable water connection is placed where the above ground fire hydrant existed. The adaptable fire connection uses the same mounting hole pattern as used in the above ground hydrant. In operation, the adaptable connection is protected by a hinged cover that is opened to provide access to the adaptable connection. The adaptable connection includes a bayonet type connection where a portable fire hydrant is secured and rotated to start the flow of water. The adaptable fire connection eliminates the appearance of the fire hydrant, the potential of a vehicle hitting a fire hydrant and the material cost associated with above ground fire hydrants.

BACKGROUND OF THE INVENTION

Most fire hydrants today exist above the surface of the ground. Most fire hydrants retained the water in a pipe that exists in the ground under the hydrant. A screw is located on top of the hydrant. When the screw is turned, it opens a valve located on the pipe and water moves from the pipe and into the hydrant. A fire person attaches a hose to a fitting on the side of the hydrant and the hose transports the water where needed to fight a fire. Current hydrants have a number of problems that have not been accurately addressed. The problems include the height of the fire hydrant above the surrounding area, making it susceptible to cars hitting the hydrant and people being injured by running into the hydrant. The hydrant is also not cosmetically pleasing. The cost of the fire hydrants is also expensive and is paid by the community for the installation, care and service of the hydrants. A number of designs have tried to address the problem with the hydrants by replacing the hydrant with a temporary cosmetic hydrant, but these designs require a modification of the pipe and or fitting that supplies water to the hydrant. Some exemplary examples of patents that have tried to address the present design of fire hydrants are presented herein.

U.S. Pat. Nos. 6,216,792 issued Apr. 17, 2001, 6,095,174 issued Aug. 1, 2000 and 5,901,738 issued May 11, 1999, all issued to Wayne Edwin Miller disclose a portable fire hydrant. The supply pipe from the water main is replaced with a custom replacement valve and up-pipe. A custom outer flange is also disclosed to protect the fittings and attachment means. The outer flange is the covered. When a fire hydrant is needed, the cover is lifted off and a portable fire hydrant is secured onto the up-pipe. A valve operator located on top of the portable fire hydrant is then turned to open the valve located in the ground near the supply line. While the Miller patents show an alternative to most present day fire hydrants, the Miller patents require alteration to the up-pipes and flanges that are being used. This would require a significant expense to change a single fire hydrant.

U.S. Pat. No. 5,803,110 issued Sep. 8, 1998 to Milton Segal discloses a fire hydrant assembly where a dummy hydrant is mounted on the custom flange. When the use of the hydrant is needed, the dummy hydrant is removed from the base and the actual hydrant is secured to the custom flange. A valve operator located on top of the portable fire hydrant is then turned to open the valve located in the ground near the supply line. While Segal discloses a replacement hydrant, the hydrant is still significantly above the surrounding landscape, making the hydrant and people susceptible to harm. The mounting flange further does not have connections for use with the bolt pattern that is common with present day fire hydrants.

U.S. Pat. No. 3,752,179 issued Aug. 14, 1973 to Luther C. Atkins et al., discloses a portable fire hydrant. The portable fire hydrant has a removable hydrant body. One of the requirements of this invention is the use of a ball valve that mounts to the existing water main. The main advantage of this design is for the ball valve to stop the flow of water if the hydrant is removed or broken from the base. In the event of damage or removal of the hydrant, a spring will push the ball valve into the valve seat to stop the flow of any additional water. While this invention provides a potable replacement hydrant, the hydrant still exists above the surrounding landscape and there is not a provision for providing a low profile cover. The invention further requires modification of the underlying valve or complete replacement of the underlying valve.

What is needed is a simple replacement to common fire hydrants that provides a low profile cover that is designed to work with the existing hole pattern of standard fire hydrants. The proposed device provides a solution with mounting flange and hydrant that can be quickly installed and removed by fire fighters when needed. When not needed a cover protects the installation site from vandalism and harm to people and vehicles.

BRIEF SUMMARY OF THE INVENTION

It is an object of the improved fire hydrant to provide a low profile alternative to fire hydrants that are currently being used. Most services that are available provided to consumers are being placed underground to reduce the visual distraction. Power lines, telephone poles, and distribution of TV signals have all been placed underground to improve the visual appearance of the community. The lower profile provides a number of benefits. First, the lower profile is more cosmetically appealing to the surrounding area. Secondly, the lower profile virtually eliminates the possibility that the hydrant will be broken off if it is struck by a vehicle. Third, the lower profile reduces the possibility that a person will be harmed by running into the hydrant.

It is another object of the improved fire hydrant to provide a hydrant that is less expensive. The savings comes from a simpler connection to the flange of the water main. The connection component is designed to mount onto the existing bolt pattern to allow for integration for new construction projects and allows for immediate integration onto existing hydrants. When a fire hydrant is needed, the installation of the hydrant onto a hydrant base is as simple as connecting the hose to a fire hydrant.

It is another object of the improved fire hydrant to provide standardization of hydrant connections. The standardization is with the connection to the water main. Each city can determine their own hose requirement and the fire hydrant or barrel can be fabricated with a discharge port configured to match the hoses being used by each city. This is particularly important when neighboring fire fighters assist another city. Today a neighboring city may not have hoses that mate with all hydrant types. With the proposed hydrant, a neighboring city would bring their own hydrant that couples with their own hoses thereby eliminating the connection problem.

It is another object of the improved fire hydrant to eliminate a flushing requirement that requires all above ground fire extinguishers to be flushed for two minutes to remove foreign debris. The elimination of this requirement will result in a significant water savings.

It is still another object of the improved fire hydrant to integrate a gear type coupling mechanism whereby the installation of the hydrant onto the coupler connects the hydrant and opens the flow of water into the hydrant. A cover plate protects the coupling from unauthorized access. When the cover plate is removed, the hydrant is placed over the coupler and rotated slightly to engage the hydrant into the base. The hydrant is further turned to open the flow of water. A gearing mechanism converts the rotation of the hydrant to rotate open the valve allowing water to flow into the hydrant and out a hose.

Various objects, features, aspects, and advantages of the present invention will become more apparent from the following detailed description of preferred embodiments of the invention, along with the accompanying drawings in which like numerals represent like components.

Figure 1:
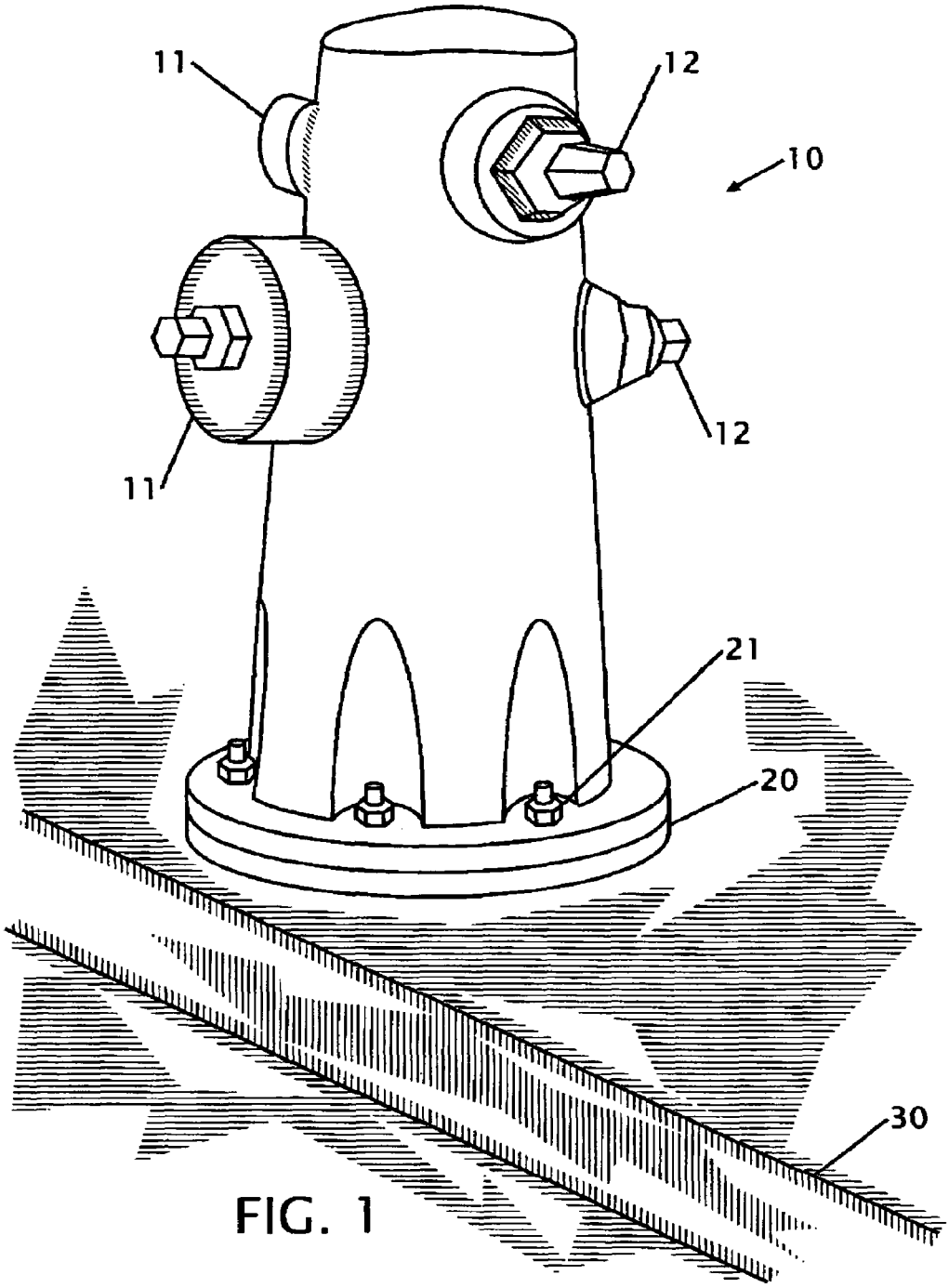
FIG. 1 shows a typical prior art fire hydrant.

| DRAWINGS - Reference Numerals | |
|---|---|
| 10 | Typical prior art fire hydrant |
| 11 | Hose connections |
| 12 | Flow control |
| 14 | Ground |
| 20 | Connection to water main |
| 21 | Mounting nuts |
| 22 | Nut/bolt clearance |
| 30 | Street curb |
| 40 | Dome cover |
| 41 | Support plate |
| 42 | Security bolt |
| 43 | Key |
| 44 | Cover retaining hole |
| 45 | Hinge |
| 46 | Gear |
| 47 | Gasket |
| 48 | Clearance hole(s) |
| 49 | Sealing lip |
| 50 | Portable fire hydrant |
| 51 | Elongated slots(s) |
| 52 | Gasket |
| 53 | Ear(s) |
| 60 | Butterfly valve |
| 70 | Handle(s) |
| 71 | Water Discharge port |
| 80 | Inner ring |
| 81 | Pinion |
| 82 | Worm |
| 83 | Worm gear |
| 84 | Shaft |
| 90 | Engagement motion |
| 91 | Turn Hydrant |

-continued

| DRAWINGS - Reference Numerals | |
|---|---|
| 92 | Turn inner ring |
| 93 | Turn pinion |
| 94 | Turn worm gear |
| 95 | Open valve |

DETAILED DESCRIPTION

FIG. 1 shows a typical prior art fire hydrant 10. Fixed above ground fire hydrants, or plugs, take a variety of configurations that are similar to the shape shown in this figure. The basic prior art fire hydrant 10 is bolted onto the connection from the water main 20. Typically, the mounting bolts are integrated into the water main connection flange 20 and the fire hydrant 10 is placed on the flange 20 and nuts 21 secure the hydrant onto the connection flange 20. Fire hydrants are typically placed on the street curb 30 for easy locating and to allow fire hoses to be easily connected. Some fire hydrants have the water pressurized with water, and when hoses are connected 11 to the hydrant the flow control valves 12 are opened to permit flow into the hoses. In other prior art hydrant designs the flow control is placed on the top of the hydrant and permits flow to all open hose connections 11.

Figure 2:
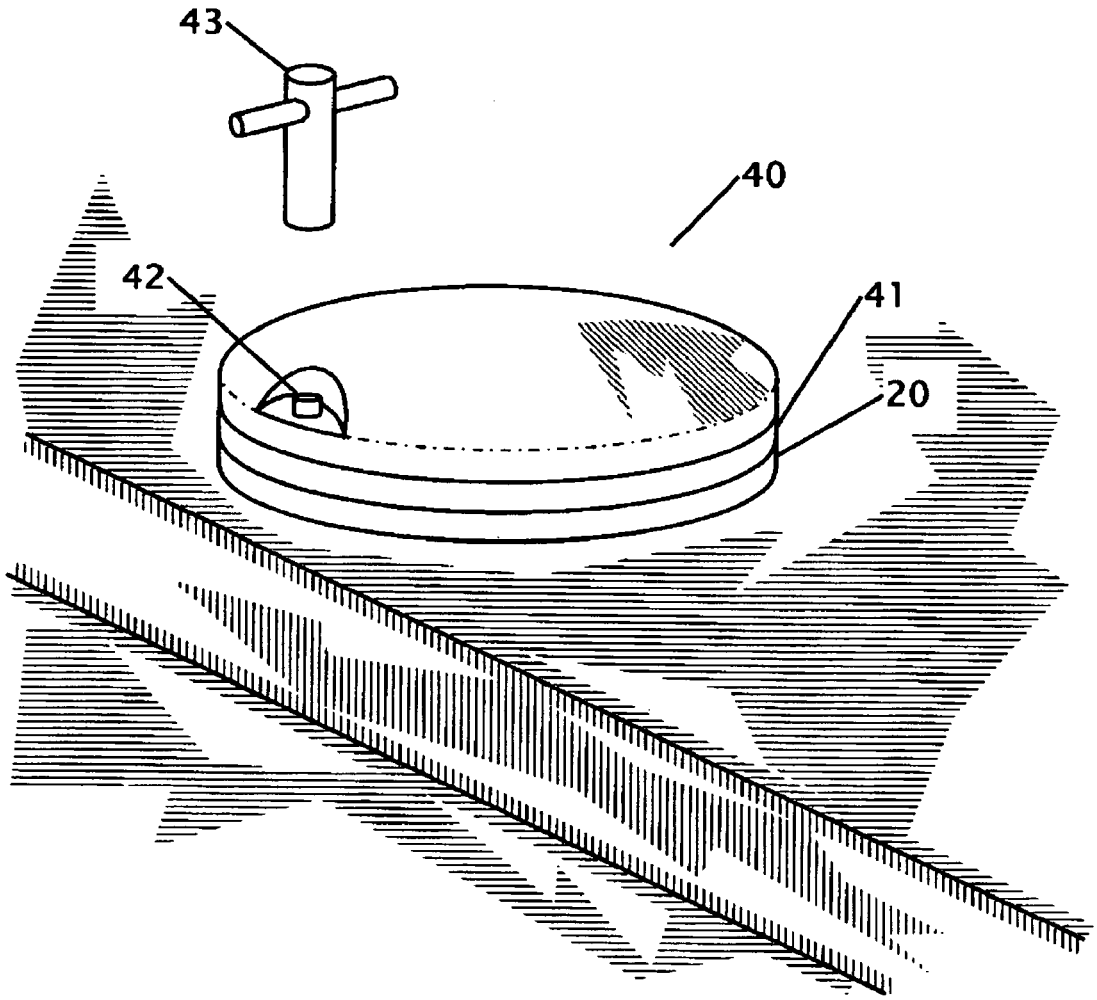
FIG. 2 shows the cover on the fire hydrant connection to the water main.

FIG. 2 shows the cover on the fire hydrant connection to the water main. This figure shows the same curb 30 and connection from the main as was shown and described in FIG. 1. The connection for the hydrant is protected under the dome cover 40. The dome cover 40 and support plate 41 connect to the water main 20 using the same bolt pattern. The use of the existing bolt pattern and connection to the water main flange 20 allows the system to be retrofit onto existing hydrants without modification. The lower profile of the dome cover 40 makes the replacement cosmetically pleasing, protects the connection from vehicular harm, and reduces potential vandalism to the hydrant. When connection of a fire hydrant is needed the fire personnel use a custom key 43, that is custom configured to reduce the potential for vandalism, on the security bolt 42 to open the dome cover 40 to gain access to connect fire equipment. While it is shown that a bolt is used to secure the dome cover 40, other methods of securing the dome cover are contemplated that include but are not limited to a threaded hardware, a latch or a locking tab. In the preferred embodiment the hardware that secures the support plate 41 are countersunk into the support plate 41. The countersunk bolts eliminate the potential to harm a fire hose or cause injury to a person.

Figure 3:
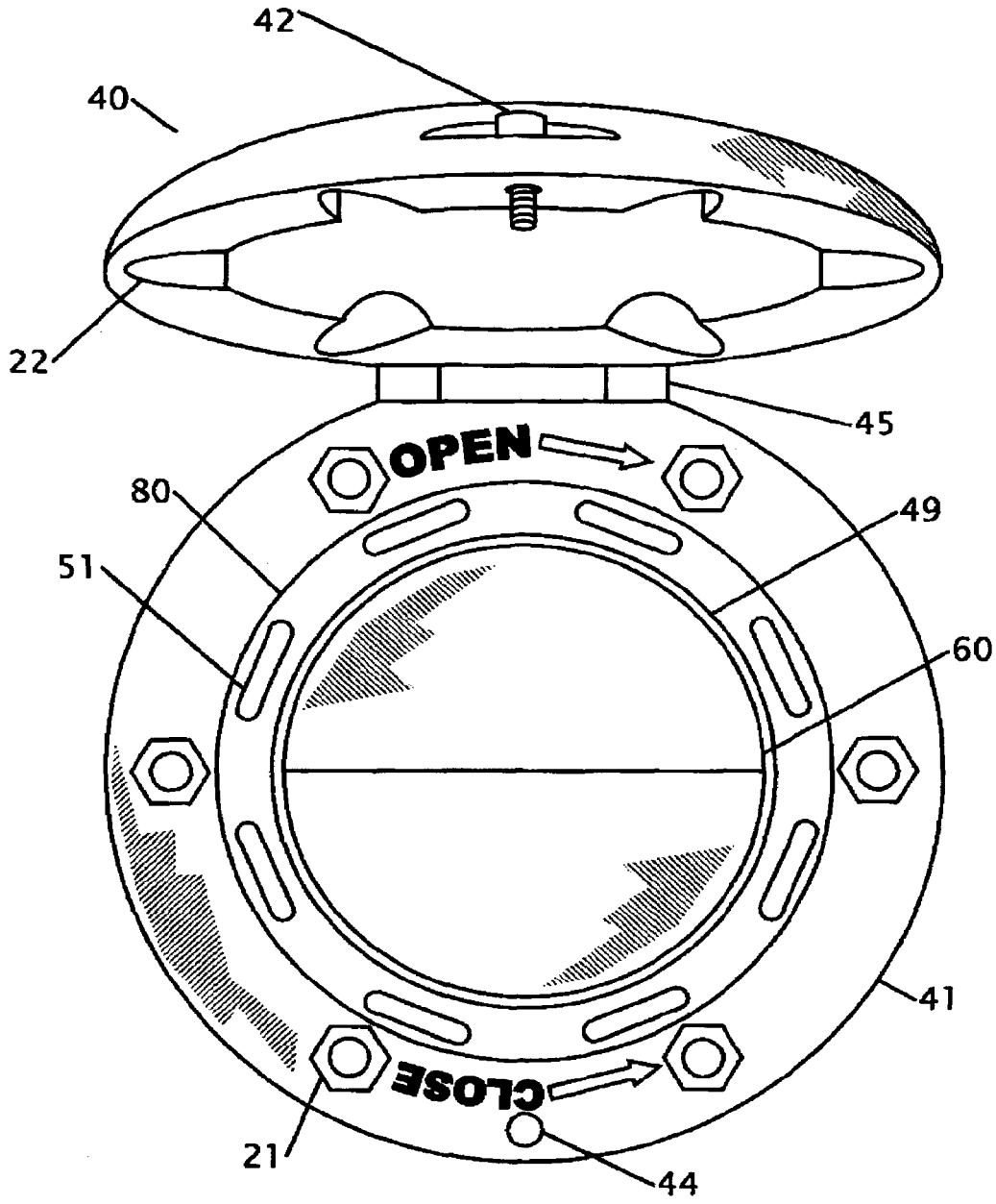
FIG. 3 shows the cover to the connection port opened.

FIG. 3 shows the cover to the connection port opened. The inside of the dome cover has recesses 22 for nut and bolt clearance. The clearance is sufficiently designed to allow the bolts and nuts to be protected from the elements and prevent tampering of the nuts. The dome cover is hinged 45 with the support plate 41. The security bolt 42 is threaded into the cover retaining hole. A simple locking mechanism is with a threaded bolt 42 that requires a specially designed key, but it is also contemplated that a key with custom lock can be used to secure the dome cover 40. The threaded hole for the locking bolt is shown as item 44 in this figure. The support plate 41 is secured to the water main flange with nuts 21 to fix the location and orientation of the support plate 41 on the water main connection. The eight elongated slots 51 exist on the inner ring 80 for retaining the ears of the portable fire hydrant. A raising sealing lip 49 extends around the inner ring. FIG. 5 shows and describes the sealing lip 49 in greater detail. The ears are shown and described in more detail with FIGS. 4 and 5. The closed butterfly valve 60 is operable to provide flow from the water main.

Figure 4:
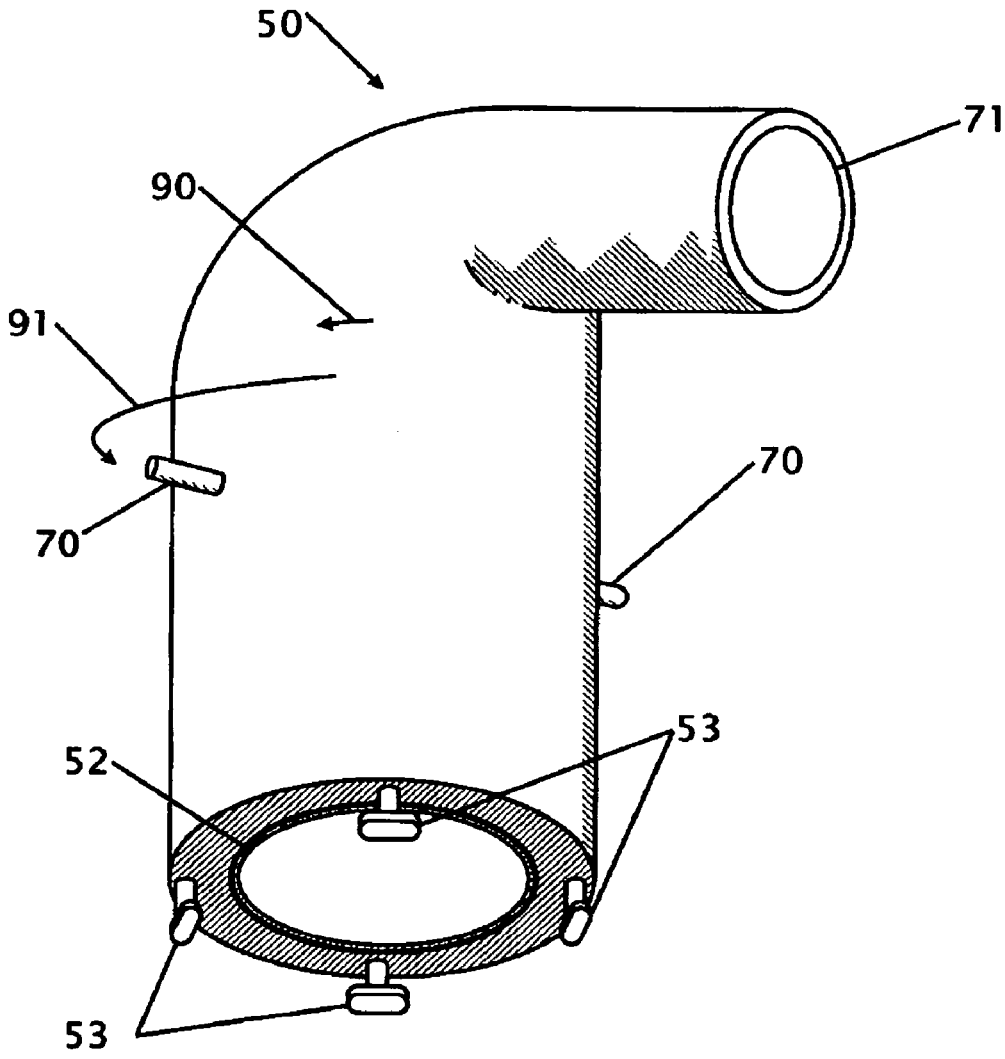
FIG. 4 shows a portable fire hydrant with the connection for the replaced base.
Figure 5:
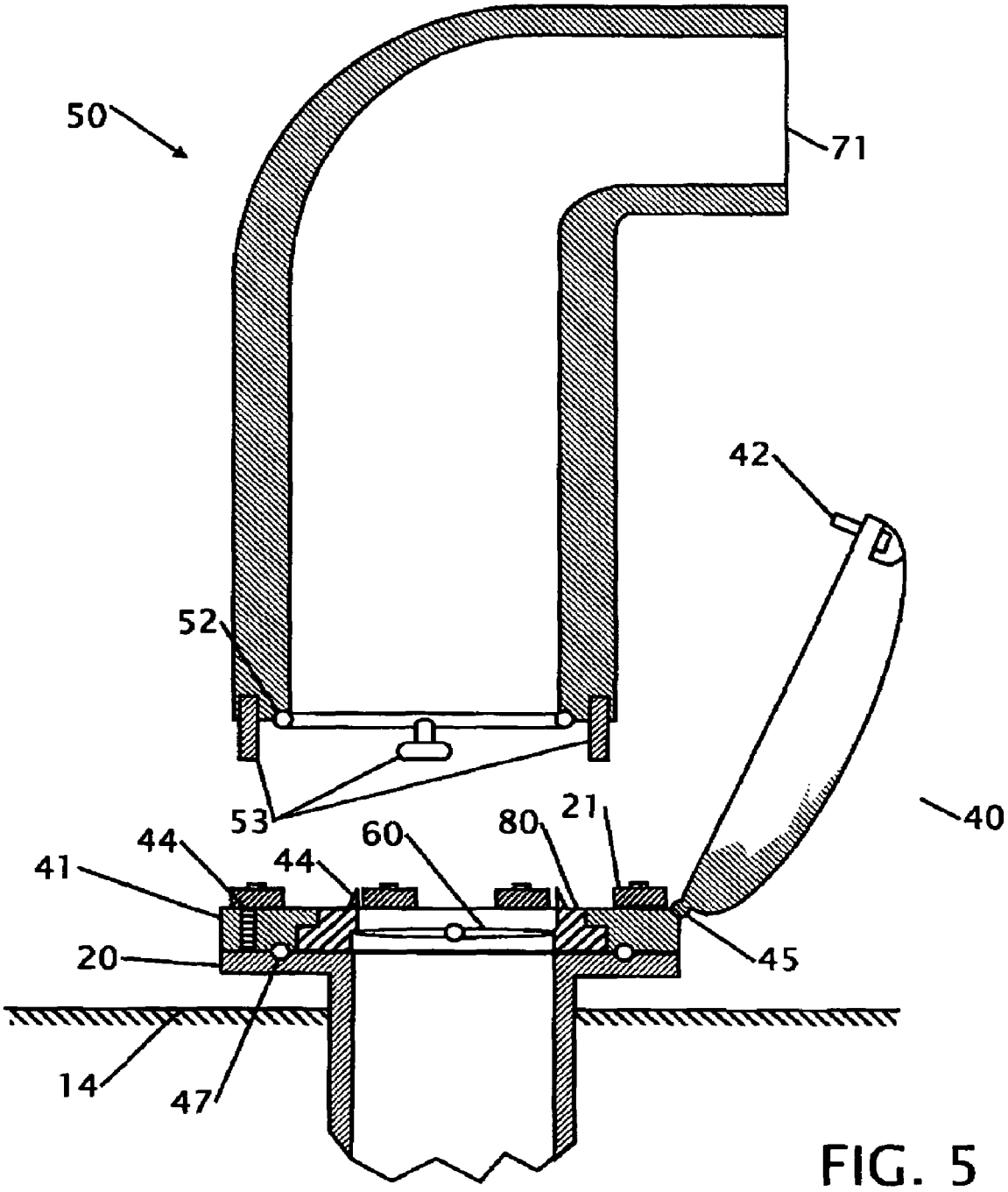
FIG. 5 shows a cross sectional view of the portable fire hydrant being connected to the opening valve.

FIG. 4 shows a portable fire hydrant with the connection for the replaced base. The portable fire hydrant 50 shown can be fabricated in a variety of heights and with a variety of water discharge ports 71 based upon the hoses being used. The sets of ears located on the bottom of the hydrant 50 are positioned over the slots 51 shown and described in FIG. 3. Once the ears 53 are placed into the slots the operator grasps the handles 70 and rotates 90 the fire hydrant 50 to engage the ears 53 in the slots located in the inner ring. A gasket 52 seals the hydrant with the inner ring. While four ears 53 are shown, it is contemplated that as few as two, three or more than four locking ears can be used to improve the stability and security of the fire hydrant in the inner ring 80). The fire hydrant can be located in one of six positions on the inner ring to give the fireperson a variety of directions they can place the hydrant based upon the desired hose direction. Additional rotation 91 of the hydrant opens the valve to allow water to flow out of the hydrant. The additional motion is shown and described in more detail with FIG. 6.

FIG. 5 shows a cross sectional view of the portable fire hydrant 50 being connected to the opening valve 60. The portable fire hydrant 50 is shown with the discharge port 71. Each city can specify the size of the discharge port 71 to mate with the hoses and hose connections they are using. Some cities require connection for 2.5" hoses, 3.5" hoses, 4" hoses or other size hose connections. While the connection end to the water main is standard with this hydrant or barrel the discharge port 71 is manufactured per specifications per county based upon the hoses from the city.

The portable fire hydrants 50 are interchangeable to accommodate different diameter discharge ports. It is also contemplated that the portable fire hydrant can be configured with multiple discharge ports to allow for multiple hoses to be connected at the same time. The ears 53 are shown on the bottom of the portable fire hydrant. Because there are only two locking ears in this hydrant 50, the elongated hole is not visible in this cross section. The inner ring 80 has a raised sealing lip 49 that allows for easier alignment of the portable fire hydrant as well and a surface for the gasket 52. The gasket 52 encircles the bottom of the hydrant to create a seal of the hydrant 50 with the inner ring 80.

The domed cover 40 is shown in its open configuration where it is pivoted on hinge 45. The dome cover 40 is not shown in cross section in this view. The securing bolt 42 is shown going through the dome cover. When the dome cover 40 is closed the securing bolt 42 is threaded (or locked) into the cover retaining hole 44. The inside of the dome cover is configured with recesses to provide clearance for the mounting nuts and bolts 21.

The supporting plate 41 is securely mounted onto the connection to the water main 20. A gasket 47 seals the supporting plate 41 and the connection to the water main 20. The connection from the water main typically extends above the ground 14, curb or street. In some cases the threaded studs are integrated into the flange connection from the water main, and in other cases the threaded studs are bolts that pass through the flange connection from the water main. This figure shows that the preferred embodiment of the design fits onto a flat water main flange 20 with no modifications to the water main mounting flange 20. The butterfly valve that seals the water main is shown as item 60. It is shown in this figure in the closed orientation, but rotates around the central axis to open. The operation of the valve is shown and described in more detail in FIG. 6.

Figure 6:
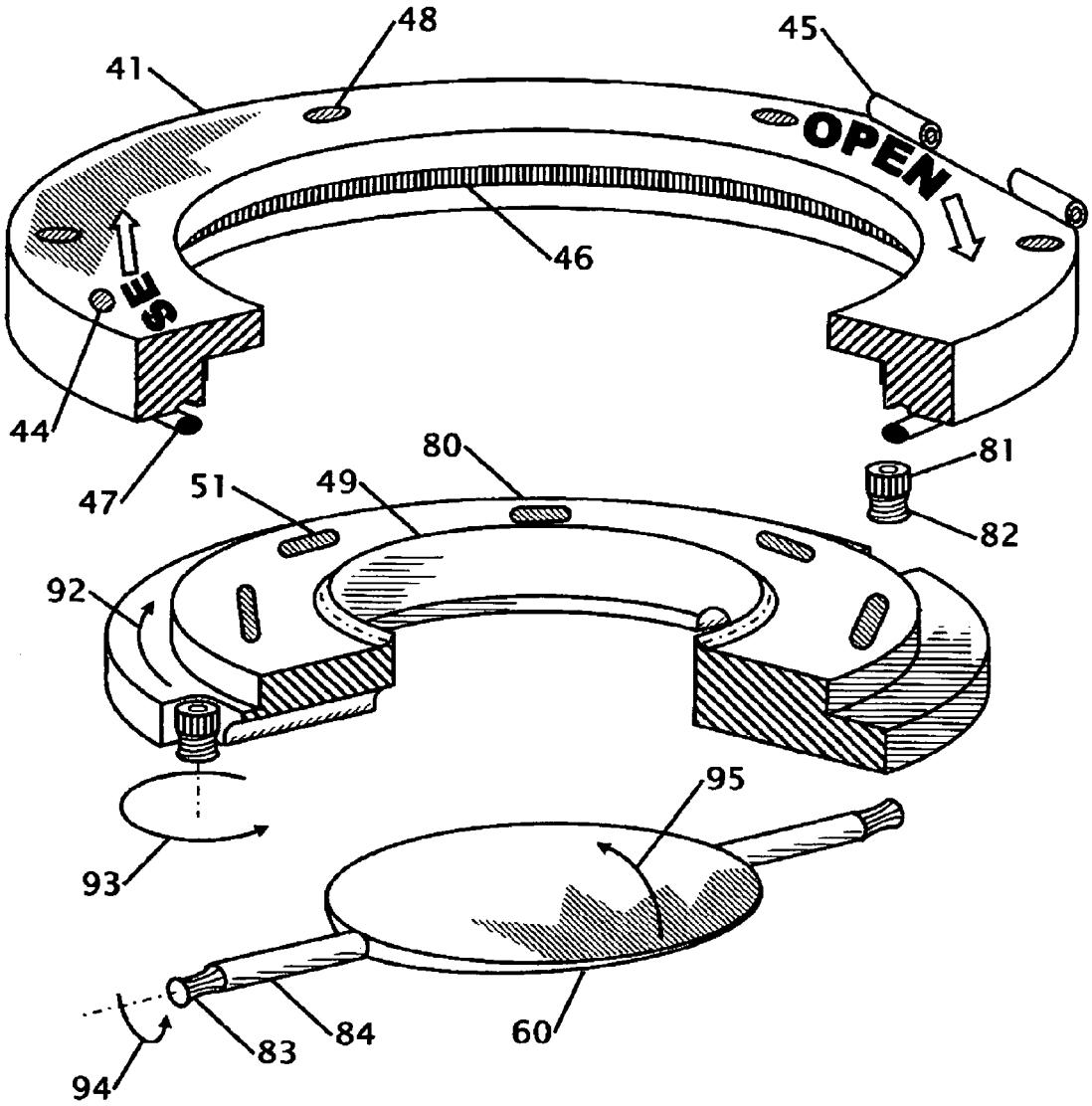
FIG. 6 shows an exploded view of the opening valve.

FIG. 6 shows an exploded view of the opening valve. The support plate 41 is shown without the dome cover attached to the hinge 45. The clearance holes 48 are for mounting the support plate 41 to the existing water main flange. The connection secures the support plate and provides a seal to water main. A gasket 47 provides a seal to accommodate surface imperfections. The threaded hole 44 for securing the dome cover is visible in this view. A gear 46 is visible going around the inside of the supporting plate. The gear 46 engages with pinions 81 that turn when the inner ring 80 is being rotated. The inner ring is rotated by rotating the body of the fire hydrant with the handles 70 (shown and described in FIG. 4). The ears from the bottom of the hydrant engage in the elongated slots 51 to secure the hydrant onto the inner ring 80. The inner ring 80 has a raised sealing lip 49 that allows for easier alignment of the portable fire hydrant as well and a surface for the gasket 52.

The butterfly valve 60 has shafts 84 extending out the ends of the disk portion of the butterfly valve. At the ends of the shafts, worm gears 83 are located. The worm gears 83 engage on worms 82 located on the opposite ends of the pinion In operation, a fire fighter will open the dome cover 40 to expose the internal structure. They will place the ears 53 on hydrant 50 into the elongated slots 51 and rotate the hydrant slightly 90 to retain the hydrant onto the inner ring 80. The fire fighter will then prep the hose. Once the fire fighter is ready to deliver water to the fire the hydrant will be rotated 91. This rotation is from ⅛ to ¼ of a turn. The rotation 91 turns the inner ring 92. When the inner ring 91 is turned, the meshing pinion 81 will turn 93 and rotate the worm 82. The worm will rotate 94 the worm gear 83 turning the shaft 84 and opening 95 the butterfly valve 60. To close the valve the hydrant is rotated in the opposite direction and the gear train closes the valve. When the hydrant is returned to its home position, the ears are disengaged and the hydrant is removed for use in another location. The dome cover is secured back onto the support plate to protect and secure the connection.

Thus, specific embodiments of a fire hydrant cover and a portable fire hydrant have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A cover and portable fire hydrant comprising:

a flanged base configured for mounting on an existing fire hydrant flange;

the flanged base further having an inner ring wherein the inner ring has a plurality of engagable slots for engagement with a removable fire hydrant and a valve closure on one side of the inner ring;

the removable fire hydrant has a plurality of mating flanges for engagement into the engagable slots whereby insertion of the mating flanges in combination with rotation of the removable fire hydrant in the inner ring secures the removable fire hydrant onto the inner ring, and further rotation of the removable fire hydrant in the inner ring opens the valve closure with a first worm pinion gear that turns a second worm gear located at the end of the valve closure with a rack that engages with a pinion configured on one end of the first worm pinion gear.

2. The cover and portable fire hydrant according to claim 1 that further includes a cover that is configured for hinged engagement with the flanged base.

3. The cover and portable fire hydrant according to claim 2 wherein the cover further includes a securing means to retain the cover in a closed and secured condition.

4. The cover and portable fire hydrant according to claim 3 wherein the securing means is with a threaded fastener.

5. The cover and portable fire hydrant according to claim 3 wherein the securing means locks the cover and further requires a key to unlock the cover.

6. The cover and portable fire hydrant according to claim 1 wherein the flanged base or the inner ring has indicia to indicate the rotational direction for opening or closing the portable fire hydrant.

7. The cover and portable fire hydrant according to claim 1 wherein the removable fire hydrant has at least one port for the flow of water through the removable fire hydrant.

8. The cover and portable fire hydrant according to claim 1 wherein the removable fire hydrant further has at least one extension arm for rotating the removable fire hydrant and the inner ring.

9. The cover and portable fire hydrant according to claim 1 wherein the removable fire hydrant has an elastomeric sealing gasket.

10. The cover and portable fire hydrant according to claim 1 wherein the inner ring has a raised annular lip to guide placement of the removable fire hydrant.

11. The cover and portable fire hydrant according to claim 1 wherein the valve closure further includes a sealing surface that mates with the inner ring.

12. The cover and portable fire hydrant according to claim 1 that further includes a sealing gasket between the flanged base and the inner ring.

13. The cover and portable fire hydrant according to claim 7 wherein the at least one port is for at least one of a 2.5", 3.5" or 4" hose.

14. The cover and portable fire hydrant according to claim 7 wherein the plurality of engagable slots allows the placement of the removable fire hydrant to be placed such that the at least one port for the flow of water is orientable in at least two directions.

15. The cover and portable fire hydrant according to claim 1 wherein the removable fire hydrant has at least four mating flanges.

16. The cover and portable fire hydrant according to claim 1 wherein the removable fire hydrant is removable from the inner ring by rotation of the removable fire hydrant in the opposite direction of engagement.

17. The cover and portable fire hydrant according to claim 1 wherein the valve closure is a butterfly valve.

* * * * *